US006755334B2

(12) United States Patent
Ballent, Jr.

(10) Patent No.: US 6,755,334 B2
(45) Date of Patent: Jun. 29, 2004

(54) AUTOMATIC NAIL FASTENING DEVICE

(75) Inventor: John Ballent, Jr., Long Beach, CA (US)

(73) Assignee: Beven Herron, Inc., La Mirada, CA (US)

( * ) Notice: Subject to any disclaimer, the term of this patent is extended or adjusted under 35 U.S.C. 154(b) by 0 days.

(21) Appl. No.: 10/246,180

(22) Filed: Sep. 18, 2002

(65) Prior Publication Data

US 2004/0050896 A1 Mar. 18, 2004

(51) Int. Cl.[7] ..... B27F 7/02

(52) U.S. Cl. ..... 227/2; 227/110; 227/111; 227/129

(58) Field of Search ..... 227/2, 7, 110, 227/111, 113, 129, 133, 132

(56) References Cited

U.S. PATENT DOCUMENTS 3,741,459 A * 6/1973 Arkush, Jr. ..... 227/3
3,764,053 A * 10/1973 Thompson ..... 227/111
3,796,365 A * 3/1974 Downing ..... 227/8
3,930,604 A * 1/1976 Pitkin et al. ..... 227/8
3,935,983 A * 2/1976 Buttriss ..... 227/110
3,957,191 A 5/1976 Nelson, Jr.
3,984,040 A * 10/1976 Fry ..... 227/7
4,084,738 A * 4/1978 Schneider ..... 227/7
4,732,307 A * 3/1988 Hubbard et al. ..... 227/7
5,169,048 A 12/1992 Himebaugh
5,381,597 A 1/1995 Petrove
5,934,504 A 8/1999 Elliott
6,064,189 A * 5/2000 Frankel ..... 324/67
6,213,371 B1 4/2001 Cabrera
6,269,996 B1 * 8/2001 McAllister ..... 227/7
6,302,310 B1 10/2001 Lamb

* cited by examiner

*Primary Examiner*—Scott A. Smith
*Assistant Examiner*—Nathaniel Chukwurah
(74) *Attorney, Agent, or Firm*—Snell & Wilmer L.L.P.

(57) ABSTRACT

An automatic nail fastening device which is capable of adjusting the spacing and patterning of the nails is presented which is especially useful for nailing decking to a roof. The device is also capable of identifying metal having a predetermined thickness in the underlying substrate so that nailing into such metal contained in the underlying substrate can be avoided.

34 Claims, 3 Drawing Sheets

AUTOMATIC NAIL FASTENING DEVICE

FIELD OF INVENTION

The present invention generally relates to an automatic nail fastening device which is controlled by a microprocessor and more particularly relates to an automatic nailing device for nailing roof decking.

BACKGROUND OF THE INVENTION

Automatic apparatus for installing shingles on a roof are known in the art. For example, U.S. Pat. No. 5,169,048 issued to Himebaugh discloses an automated shingling apparatus for applying strips of shingling material to a roof which includes a frame having a motorized drive belt assembly. A roll of shingling strip material is carried on the frame and movement of the belt assembly unwinds the shingling material from the roll and deposits it on the roof. A series of actuators are mounted on the drive belt and as the assembly belt moves, the actuators pass by and periodically engage the trigger of a nail gun positioned on the frame thereby fastening the shingling material to the roof in timed relation to the movement of the apparatus.

Another automatic shingling patent, namely U.S. Pat. No. 5,381,597 issued to Petrove, discloses a shingling apparatus that applies shingles to a roof in successive steps. The apparatus includes a frame having a wheel assembly with air driven motors to vertically move the apparatus. A hopper on the frame holds the shingles while a shuffle bar moves across the shingles, placing them one at a time onto forks. The forks move from the frame to the roof where the shingle is placed and then fastened to the roof with a pneumatic nail gun. When the forks return to their starting position to retrieve the next shingle, the apparatus moves toward the top of the roof in a vertical direction. The apparatus is attached to nylon belts which are fastened at the top of the roof to a linear motion brace. The movement of the apparatus is performed through the use of many sensors and a microprocessing system.

The present invention differs from the automatic shingling apparatus of the prior art in that it is directed toward an automatic nailing device that is capable of nailing decking to a roof, especially commercial roof deck, instead of nailing shingling to a roof deck. Nailing of roof deck to a roof frame may require various spacing and patterning of the nails to accommodate different types of roof structures. Accordingly, an automatic nailing apparatus is needed which is capable of automatically nailing decking to a roof structure where the spacing and patterning of the nails can be altered according to the roof structure. There is also a need for an automatic nailing apparatus for nailing decking to a roof which can identify metal plates which exceed a predetermined thickness and which are attached to the roof structure so that nailing into the metal plates of the roof structure can be avoided.

SUMMARY OF THE INVENTION

It is a principal object of the present invention to provide an automatic nail fastening device which is capable of adjusting the spacing and patterning of the nails.

It is another object of the present invention to provide an automatic nail fastening device which is especially useful for nailing decking to a roof and which is also capable of identifying metal having a predetermined thickness in the underlying roof structure so that nailing into metal contained in the underlying roof structure can be avoided.

The present invention comprises an automatic nail fastening device having a frame, at least one wheel attached to the frame to allow for movement of the frame, at least one nail gun attached to the frame and means for activating the nail gun such as, for example, a pneumatic system where pressurized air can be used to activate the nail gun, a sensor for sensing a distance traveled which sends a signal to a microprocessor regarding the distance traveled, the microprocessor receiving the signal from the sensor and controlling the means for activating the nail gun, and a power source for the microprocessor.

In another aspect of the invention, the automatic nail fastening device may include a detector for sensing metal which exceeds a predetermined thickness or threshold level that is located in the path of the nail gun where the detector sends a signal to the microprocessor to prevent the nail gun from nailing into the metal.

In still another aspect of the invention, the microprocessor is capable of controlling the spacing and pattern of the nails that are nailed with the nail gun.

In yet another aspect of the invention, the automatic nail fastening device includes means for feeding nails into the nail gun.

In yet another aspect of the device, a pair of handles and a control panel may be included. The handles allow a user to more easily push the device. Safety levers and a push button for manually activating the nail gun may also be positioned near the handles to enable easy access to such features by the user. The control panel may include an "on/off" switch, means for selecting the spacing and or pattern of the nails, and one or more light emitting diodes for indicating device status such as low battery, inaccurate nail spacing and realignment for proper spacing, and whether the device is on or off.

The present invention also includes a method for automatically fastening nails to a substrate which includes the steps of providing a device having a frame, at least one nail gun mounted to the frame, means for activating the nail gun, and means for moving the frame, locating an edge of the substrate with the device, inputting spacing and/or patterning of the nails into a microprocessor, moving the device along the substrate, sensing a distance traveled by the device and sending a signal to the microprocessor in relation to the distance traveled, receiving the signal with the microprocessor, and activating the nail gun in response to the received signal.

BRIEF DESCRIPTION OF THE DRAWINGS

Additional aspects of the present invention should become evident upon reviewing the non-limiting embodiments described in the specification taken in conjunction with the accompanying figures, wherein like numerals designate like elements, and.

DETAILED DESCRIPTION

The following descriptions are of exemplary embodiments of the invention only, and are not intended to limit the scope, applicability or configuration of the invention in any way. Rather, the following description is intended to provide a convenient illustration for implementing various embodiments of the invention. As will become apparent, various changes may be made in the function and arrangement of the elements described herein without departing from the spirit and scope of the invention. For example, though not specifically described, many shapes and orientations of the frame and positioning of elements on the frame should be understood to fall within the scope of the present invention.

Figure 1:
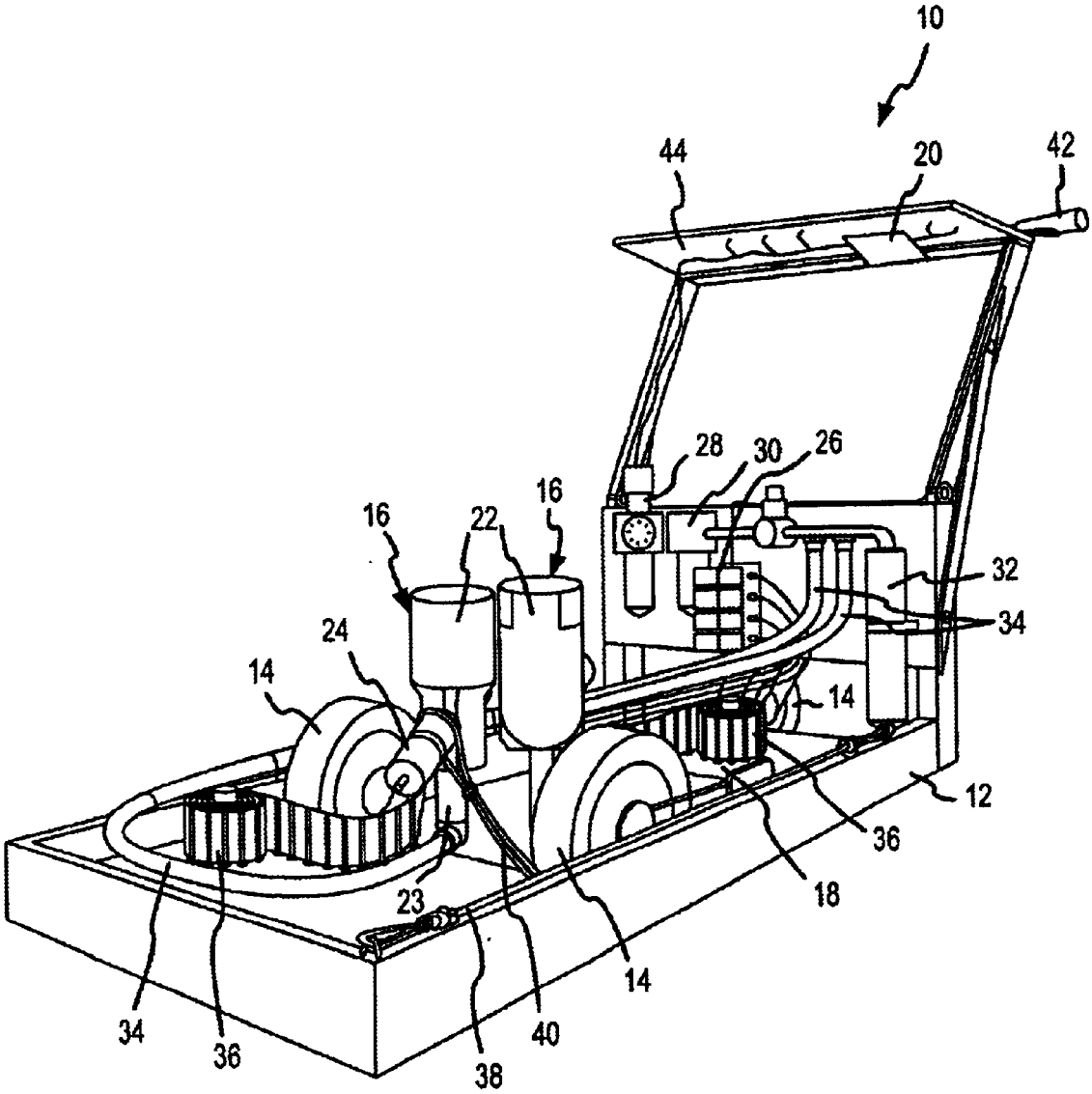
FIG. 1 is a perspective view of one embodiment of the automatic nail fastening device of the present invention.

As shown in FIG. 1, the present invention is generally directed to an automatic nail fastening device 10 which includes a frame 12, at least one wheel 14 attached to the frame 12 to enable movement of the frame 12, at least one nail gun 16 attached to the frame 12 and means for activating the nail gun 16, a sensor 18 attached to the wheel 16 of the frame 12 for sensing a distance traveled wherein the sensor 18 is capable of sending a signal in relation to the distance traveled, a microprocessor 20 for receiving the signal from the sensor 18 and for controlling the means for activating the nail gun 16, such as, for example, Microchip microprocessor 17C756 which is programmed to control operations of the device, and a power source (See FIG. 2) for the microprocessor 20. The embodiment of the automatic nail fastening device 10 shown in FIG. 1 includes two wheels 14 positioned in parallel and a third wheel 14 positioned equidistant between the parallel wheels 14 but at a predetermined length away from parallel wheels 14, and two nail guns 16 attached to the frame.

This embodiment also shows pneumatic means for activating the nail guns 16 which comprises pneumatic nail guns 16 each having a housing 22 containing pressurized air and means for retaining nails, and a handle 24 attached to the housing. Guns 16 are attached to frame 12 by mounting each nail gun 16 on a pivoting mechanism located near the end of handles 24 which is in turn mounted to frame 12. Nail guns 16 used in the present invention are standard nail guns or roofing guns which utilize pneumatic actuators such as, for example, guns having product number NV83A manufactured by Hitachi. In employing a standard nail gun or roofing gun, a user depresses a trigger on the handle of the gun and then taps the nose of the gun to the substrate or decking to be nailed in order to depress a nose safety release on the gun which is also known as a probe tip or touch probe. A nail is fired once the probe tip is sufficiently depressed and the tip must be completely released before another nail can be fired.

In the present invention, the trigger on handle 24 is retained in a depressed position by a restraint such as a rubber bungee cord or the like. Nail guns 16 are mounted on a pivoting mechanism which is held away from the substrate or roofing deck by a pneumatic actuator 23. In order to carry out the firing of a nail, the microprocessor sends a signal to an air control valve 26 which in turn removes air pressure from the actuator air cylinder 23 which then allows gun 16 to fall to the substrate or roof decking. When gun 16 falls to the substrate or decking, the probe tip on gun 16 is depressed and a nail is fired. Air control valve 26 may actually comprise a plurality of air control valves which control the air pressure that functions to operate various elements of the device. Wires connect each air control valve to microprocessor 20.

After a predetermined amount of time, air control valve 26 is de-energized which results in putting pressure on actuating air cylinder 23 thereby returning gun 16 to its upright non-firing position. It will be understood by those skilled in the art that additional downward force may also be applied to gun 16 instead of relying on the force of gravity alone to drop gun 16 to the substrate or roof decking. Examples of means for applying additional downward force include, but are not limited to, using an external spring, or supplying air pressure to the other side of actuating air cylinder 23.

A lubricator 30 for adding an oil mist to the air system and an air accumulator 32 may each be connected to actuating air cylinder 23 by way of air hoses 34. An air pressure regulator 28 controls the nailing force of gun 16 thereby controlling how hard the nail is driven into a substrate or roof decking. In addition, a regulator for controlling the air pressure of actuating air cylinder 23 (in order to control how hard gun 16 is returned to an upright non-firing position) and a regulator for controlling how much downward force is applied on actuating air cylinder 23 to drive gun 16 to a substrate or roof decking.

The embodiment in FIG. 1 also shows means for feeding nails into the nail guns 16 which comprises coils of nails 36, where the nails are contained on a backing, which feed into pneumatic nail guns 16. The coils of nails 36 unroll as nails are fed into pneumatic nail guns 16. A detector (not shown) may be attached underneath frame 12 in a position so that a predetermined thickness of metal located in the path of nail guns 16 may be detected and result in a signal being sent to microprocessor 20 which controls nail guns 16 so that nail guns 16 will not fire into the metal. A rope 38 is also shown which is used to secure frame 12 while being lifted to a roof for use. Bungee cords 40 are also shown in this embodiment for holding the releases on pneumatic nail guns 16 in the "on" position so that automatic nailing controlled by microprocessor 20 can take place.

FIG. 1 also shows one handle 42 of a pair of handles and a control panel 44 which are later described in detail with reference to FIG. 2. In order to facilitate computer control of automatic nail fastening device 10, microprocessor 20 is attached to control panel 44 which is located such that control panel 44 is in close reach of a user moving the automatic nail fastening device 10 by pushing on the pair of handles.

Figure 2:
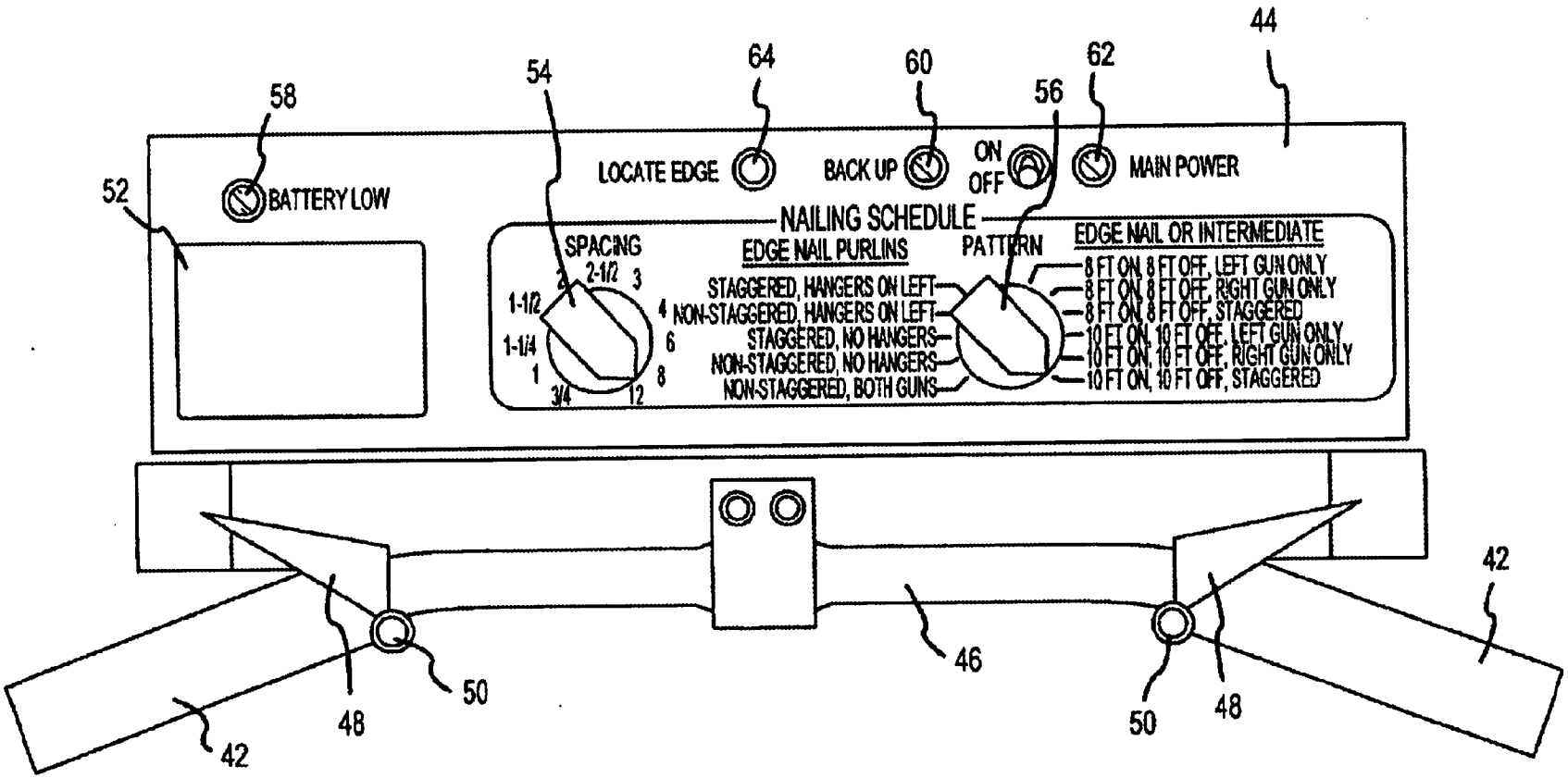
FIG. 2 is a top plan view of the control panel and handles of the automatic nail fastening device of the present invention.

A top plan view of the handles 42 and control panel 44 of automatic nail fastening device 10 is shown in FIG. 2. Handles 42 are attached to a support bar 46. Safety levers 48 and push buttons 50 may also be attached to support bar 46 near handles 42 to enable a user to manually deactivate or activate nail guns 16.

Control panel 44 includes a battery 52 which is attached to microprocessor 20 to power microprocessor 20. Other means may also be used to power microprocessor 20 such as a fuel cell or solar power. Control panel 44 also includes a nailing schedule having means for selecting spacing of the nails, such as dial 54 and means for selecting the pattern of the nails, such as dial 56. The selection means are connected to the microprocessor 20 which controls nail guns 16. Control panel 44 may also include one or more light emitting diodes (LEDs) for indicating a status of automatic nail fastening device 10 such as, for example, a low battery LED 58, an LED 60 to signal inaccurate nail spacing and realignment of the device for proper spacing, and an LED 62 to indicate whether or not device 10 is on or off. The control panel also includes a push button 64 for locating the edge of the substrate to be nailed so that a user can set or reset the device so that it employs the proper nailing pattern. The nailing pattern repeats every two feet when nailing along a four foot edge of roof sheeting and repeats every sixteen feet when nailing along an eight foot edge of roof sheeting. Therefore, the automatic nailing device must start the nailing pattern in a known position relative to the roof sheeting edge. An indicator is attached to frame 12 of the device which is positioned approximately ¼ of an inch above the roof sheeting so that the operator of the device can easily see the indicator from his normal operating position. As the user or operator maneuvers the device into position, the user will push the device forward until the indicator is over the edge of the roofing sheet. The user then presses push button 64 which is connected to microprocessor 20 by a cable. Depressing push button 64 signals to microprocessor 20 that the device is in proper position for starting the designated nail pattern.

In addition to the above described LEDs, there may also be an LED to indicate that guns 16 are over a metal piece having a predetermined target thickness and are therefore not going to fire. The detector is positioned ahead of guns 16 in the device's direction of motion. Microprocessor 20 compensate for the distance between the detector and each individual gun 16 thereby enabling it to disable each gun 16 in turn as it later passes over the previously detected metal having a predetermined target thickness.

Figure 3:
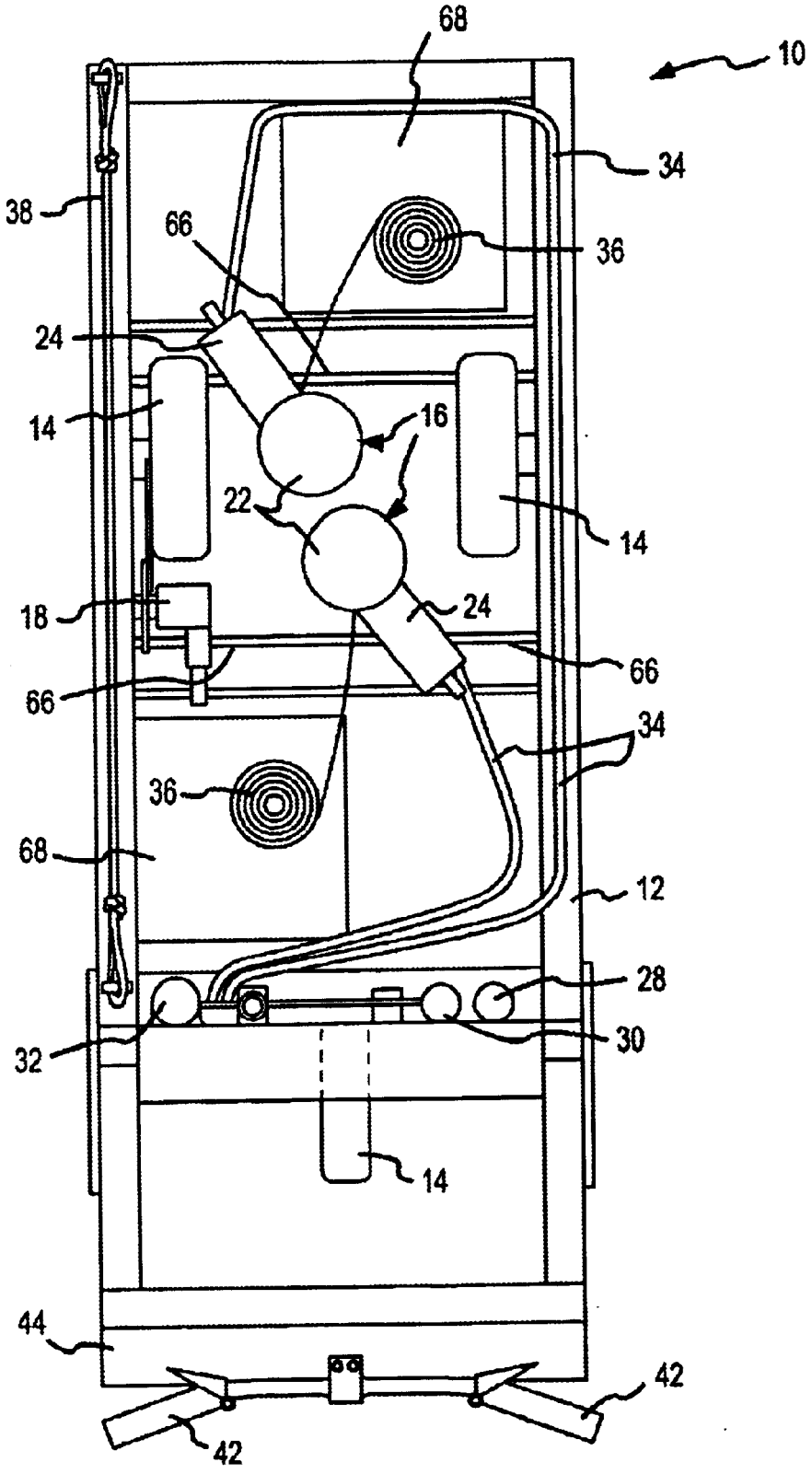
FIG. 3 is a top plan view of another embodiment of the automatic nail fastening device of the present invention.

Turning now to FIG. 3, a top plan view of another embodiment of automatic nail fastening device 10 is shown. As with the embodiment shown in FIG. 1, device 10 includes frame 12, wheels 14, pneumatic air guns 16 each having housing 22 and handle 24, sensor 18, microprocessor (not shown), air control valve (not shown), air pressure regulator and filter 28, lubricator 30, air accumulator 32, hoses 34, nail coils 36, rope 38, handles 42, and control panel 44. However, in this embodiment, device 10 also includes one or more rails 66 for mounting nail guns 16 thereon so that the position of nail guns 16 can be adjusted along the length of rails 66. It should be noted that nail guns 16 shown in FIG. 1 are secured to frame 12 with brackets (not shown). It should also be noted that platforms 68 for supporting nail coils 36, although not shown in FIG. 1, are also present in the embodiment shown in FIG. 1. It will be understood by those skilled in the art that nail guns 16 may also be positioned and secured at an angle for firing.

The metal detector included in the present invention is located below the front coil of nails on the centerline of the device, and in alignment with guns 16, approximately six inches in front of the forward most gun. One exemplary embodiment of the metal detector may comprise a rectangular shape that is approximately 1.5 inches in height, 4 inches wide, and 4 inches in length. A single cable connects the detector to the microprocessor of the present invention. An example of a metal detector which can be used in the present invention is a detector manufactured by Turck having product number Bi5OU-Q80-AP6X2-H1141.

The automatic nail fastening device of the present invention enables decking to be attached to a roof in a fast and efficient manner while still ensuring that the nails are adequately secured in the substrate. Differences in type of substrate can be accommodated for by adjusting the air pressure for the pneumatic nail gun. It should also be understood by those skilled in the art that other means for activating the nail guns may also be used such as electronic means.

What is claimed is:

1. An automatic nail fastening device comprising:

a frame;

at least one wheel attached to said frame for enabling movement of the frame;

at least one nail gun attached to the frame;

at least one rail attached to the frame for mounting said at least one nail gun so that said at least one nail gun can be laterally adjusted along a length of the rail;

means for activating the nail gun;

a sensor attached to the frame for sensing a distance traveled, said sensor being capable of sending a signal in relation to said distance;

a microprocessor for receiving the signal from said sensor and controlling the nail gun; and a power source for said microprocessor.

2. The automatic nail fastening device of claim 1 further comprising a detector for sensing metal having a predetermined thickness located in a path of the nail gun wherein said detector sends a signal to the microprocessor to prevent the nail gun from nailing into the metal.

3. The automatic nail fastening device of claim 1 wherein said microprocessor controls said means for activating the nail gun, spacing of the nails, and a pattern of nailing.

4. The automatic nail fastening device of claim 1 further comprising means for feeding nails into the nail gun.

5. The automatic nail fastening device of claim 1 further comprising a pair of handles attached to the frame for enabling a user to push the device.

6. The automatic nail fastening device of claim 5 further comprising a push button for manually activating the nail gun.

7. The automatic nail fastening device of claim 6 further comprising a safety lever attached to each of said handles.

8. The automatic nail fastening device of claim 5 further comprising a control panel positioned near the handles.

9. The automatic nail fastening device of claim 8 wherein said control panel comprises a switch for turning the device on and off.

10. The automatic nail fastening device of claim 9 wherein said control panel further comprises at least one of a means for selecting spacing of nails and means for selecting a pattern for nailing.

11. The automatic nail fastening device of claim 10 wherein said control panel further comprises one or more light emitting diodes for indicating at least one of a low battery, an inaccurate nail spacing and realignment for proper spacing, and an "on" status.

12. The automatic nail fastening device of claim 1 wherein said power source comprises at least one of a battery, a fuel cell, or a solar source.

13. The automatic nail fastening device of claim 1 wherein said means for activating the nail gun includes an actuator air cylinder which is connected to an air control valve which is controlled by the microprocessor.

14. The automatic nail fastening device of claim 7 wherein said means for activating the nail gun further includes:

an air pressure regulator;

an air filter; and a lubricator.

15. The automatic nail fastening device of claim 1 further comprising means for locating an edge of substrate for nailing.

16. The automatic nail fastening device of claim 1 wherein an angle of said at least one nail gun is adjustable with respect to a nailing surface.

17. An automatic nailing device for installing roof decking comprising:

a frame;

a pair of wheels attached to said frame for enabling movement of the frame;

a pair of nail guns attached to the frame;

pneumatic means for activating the nail guns;

a sensor for sensing a distance traveled, said sensor being capable of sending a signal relating to said distance;

a microprocessor capable of receiving the signal from said sensor and triggering the pneumatic means in response to receiving the signal;

a detector for sensing a metal having a predetermined thickness in a path of the nail guns, said detector capable of sending a signal to the microprocessor to prevent the nail guns from nailing into the metal; and a power source for said microprocessor.

18. The automatic nail fastening device of claim 17 wherein said microprocessor is capable of controlling spacing of nails that are emitted from the nail guns and a pattern for nailing the nails.

19. The automatic nail fastening device of claim 17 further comprising means for feeding nails into the nail guns.

20. The automatic nail fastening device of claim 17 further comprising a pair of handles connected to said frame wherein each of said handles includes a safety lever.

21. The automatic nail fastening device of claim 17 wherein said power source comprises at least one of a battery, a fuel cell, or a solar source.

22. The automatic nail fastening device of claim 17 further comprising at least one push button for manually triggering the pneumatic means.

23. The automatic nail fastening device of claim 17 further comprising means for locating an edge of roof decking.

24. The automatic nail fastening device of claim 17 further comprising a control panel connected to said frame.

25. The automatic nail fastening device of claim 24 wherein said control panel comprises a switch for turning the device on and off.

26. The automatic nail fastening device of claim 25 wherein said control panel further comprises at least one of a means for selecting spacing of nails and means for selecting a pattern for nailing.

27. The automatic nail fastening device of claim 26 wherein said control panel further comprises one or more light emitting diodes for indicating at least one of a low battery, an inaccurate nail spacing and realignment for proper spacing, and an "on" status.

28. The automatic nail fastening device of claim 17 further comprising at least one rail attached to the frame for mounting at least one nail gun so that said at least one nail gun can be laterally adjusted along the length of the rail.

29. The automatic nail fastening device of claim 17 wherein an angle of said at least one nail gun is adjustable with respect to a nailing surface.

30. A method for automatically fastening nails to a substrate comprising the steps of:

providing a device having a frame with at least one rail, at least one nail gun mounted to the rail so that said at least one nail gun can be laterally adjusted along a length of the rail, means for activating the nail gun, and means for moving the frame;

locating an edge of the substrate with the device;

inputting a length of space between nails into a microprocessor;

moving the device along the substrate;

sensing a distance traveled by the device and sending a signal to the microprocessor;

receiving the signal with the microprocessor;and activating the nail gun in response to the received signal.

31. The method of claim 30 further comprising the steps of:

detecting a metal having a predetermined thickness located in the path of the nail gun; and sending a different signal to the microprocessor to prevent actuation of the nail gun.

32. The method of claim 30 further comprising the step of inputting a pattern for nailing the nails into the microprocessor prior to moving the device along the substrate.

33. The method of claim 30 wherein said step of activating the nail gun comprises the steps of:

sending a signal from the microprocessor to an air control valve; and activating the air control valve to remove air pressure from an actuator air cylinder connected to the nail gun.

34. An automatic nail fastening device comprising:

a frame;

at least one wheel attached to said frame for enabling movement of the frame;

at least one nail gun attached to the frame;

means for activating the nail gun;

a sensor attached to the frame for sensing a distance traveled, said sensor being capable of sending a signal in relation to said distance;

a microprocessor for receiving the signal from said sensor and controlling a nail gun;

a power source for said microprocessor; and a detector for sensing metal having a predetermined thickness located in a path of the nail gun wherein said detector sends a signal to the microprocessor to prevent the nail gun from nailing into the metal.

* * * * *